US009990807B2

(12) United States Patent
Leger et al.

(10) Patent No.: US 9,990,807 B2
(45) Date of Patent: Jun. 5, 2018

(54) METHOD AND SYSTEM FOR CONTROLLING A GRAPHICAL USER INTERFACE OF A TERMINAL

(71) Applicant: IGT Canada Solutions ULC, Moncton (CA)

(72) Inventors: Francois Leger, Dieppe (CA); Bethany Trainor, Dieppe (CA); Isabelle Marie Arsenault, Grand-Barachois (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 229 days.

(21) Appl. No.: 14/863,856

(22) Filed: Sep. 24, 2015

(65) Prior Publication Data

US 2016/0093171 A1 Mar. 31, 2016

Related U.S. Application Data

(60) Provisional application No. 62/055,783, filed on Sep. 26, 2014.

(51) Int. Cl.
*G07F 17/32* (2006.01)

(52) U.S. Cl.
CPC ..... *G07F 17/3283* (2013.01); *G07F 17/3204* (2013.01)

(58) Field of Classification Search
CPC ... G07F 17/32; G07F 17/3204; G07F 17/3283
See application file for complete search history.

(56) References Cited

U.S. PATENT DOCUMENTS 6,290,600 B1 * 9/2001 Glasson ..... G07F 17/3265 273/143 R
6,569,018 B2 * 5/2003 Jaffe ..... A63F 13/10 463/25
7,008,324 B1 * 3/2006 Johnson ..... G07F 17/3211 345/156
2008/0108423 A1 * 5/2008 Benbrahim ..... G07F 17/34 463/25
2009/0191942 A1 * 7/2009 Bennett ..... G07F 17/32 463/20
2009/0270173 A1 * 10/2009 Christensen ..... G07F 17/32 463/42

(Continued)

*Primary Examiner* — Omkar Deodhar
*Assistant Examiner* — Shauna-Kay Hall
(74) *Attorney, Agent, or Firm* — Sage Patent Group

(57) ABSTRACT

A community gaming system including a central controller and a plurality of gaming terminals each with a graphical user interface operating. The system determines that a bonus event is triggered and which of the terminals qualify. The central controller transmits a trigger signal to each of the qualified gaming terminals in the sequence in turn, in response to which each qualified gaming terminal initiates scrolling of a bonus event graphic across its respective graphical user interface such that as the bonus event graphic scrolls across the graphical user interface of one of the qualified gaming terminals to reach an edge of that graphical user interface a next one of the qualified gaming terminals in the sequence then initiates scrolling of that bonus event graphic across its graphical user interface. The bonus event graphic appears to scroll across successive graphical user interfaces of the sequence of terminals.

22 Claims, 10 Drawing Sheets

(56) References Cited

U.S. PATENT DOCUMENTS

| | | | | |
|---|---|---|---|---|
| 2010/0120503 | A1* | 5/2010 | Hoffman | G07F 17/3272 463/20 |
| 2011/0034239 | A1* | 2/2011 | Collette | G07F 17/32 463/26 |
| 2011/0065495 | A1* | 3/2011 | Hornik | G07F 17/3213 463/25 |
| 2011/0070940 | A1* | 3/2011 | Jaffe | G07F 17/32 463/20 |
| 2012/0115593 | A1* | 5/2012 | Vann | G07F 17/34 463/26 |
| 2013/0065659 | A1* | 3/2013 | Johnson | G07F 17/3248 463/16 |
| 2013/0217505 | A1* | 8/2013 | Wright | G07F 17/3267 463/42 |
| 2014/0335930 | A1* | 11/2014 | Fujisawa | G07F 17/3244 463/20 |

* cited by examiner

METHOD AND SYSTEM FOR CONTROLLING A GRAPHICAL USER INTERFACE OF A TERMINAL

FIELD OF THE APPLICATION

The present application relates to the control of graphical user interfaces and, in particular, to control of graphical user interfaces in connection with gaming applications, and more particularly, to control of multiple graphical user interfaces in a community gaming implementation.

BACKGROUND

Modern casinos are increasingly moving toward electronic and computerized implementations for their gaming machines. For example, slot machines historically were mechanical devices whose physical reels could be spun by pulling a lever on the side of the machine. Each symbol on each reel occupied a physical stop having the same probability of occurrence as all other stops on the reel, and the machine would pay out based on the combination of symbols appearing in a line across the reels (the "payline") when all of the reels stopped spinning. Today, however, mechanical reels in slot machines are typically controlled electronically, such that different payline probabilities can be assigned to different symbols on the reels. The reels can be spun by pushing a button that activates the electronic control, although some machines may retain the traditional lever for entertainment value. In newer video slot machines, the physical reels are replaced by virtual reels whose symbols are displayed on a video screen, controlled by one or more computer processors. Some video slot machines have physical buttons for the player to press, while others are operated via touchscreen.

An electronic gaming machine is typically programmed, via software or firmware, to pay out as winnings, in the long run, a particular percentage of the money that is paid in by players as wagers. This is typically done by setting the probabilities for individual payouts in the machine's control system. For example, if a machine gives a payout of 10 times the player's wager with a probability of 5%, and a payout of 20 times the player's wager with a probability of 2%, then the machine has a theoretical payout percentage of 90%. The remaining 10% of the wagers are kept by the "house" (i.e., the slot machine operator—typically the casino) as profits. The payouts that result from various combinations of symbols appearing on a payline when the reels stop spinning are typically listed in a pay table that may be displayed somewhere on the machine. The probability of each payout can thus be controlled by setting the probabilities of the individual symbols that must co-occur on the payline to produce that payout.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
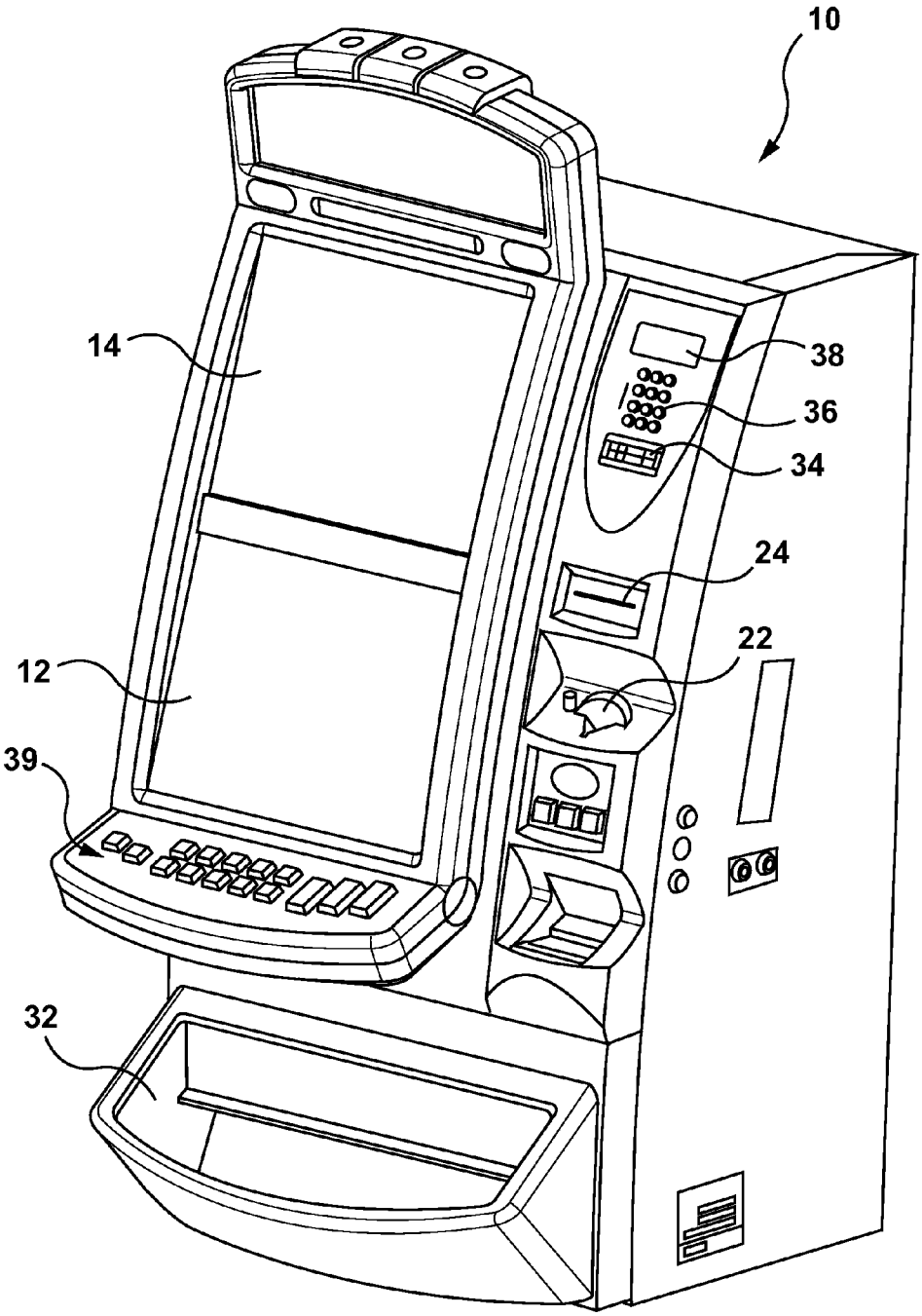
FIG. 1 is a perspective view illustrating an exemplary cabinet housing a casino game machine in accordance with some embodiments.

In one aspect, the present application discloses a method of controlling a plurality of graphical user interfaces, wherein the plurality of graphical user interfaces form a community gaming system, each graphical user interface operating as a gaming terminal. The system includes at least one central controller. The method includes each gaming terminal determining, based upon regular user gaming input received at that gaming terminal and a first probability, whether that gaming terminal qualifies for a bonus event as a qualified gaming terminal. The method further includes determining, at the central controller, based upon a second probability, that the bonus event is triggered; identifying, by the central controller, a sequence of qualified gaming terminals for the bonus event; transmitting a trigger signal from the central controller to each of the qualified gaming terminals in the sequence in turn, in response to which each qualified gaming terminal initiates scrolling of a bonus event graphic across its respective graphical user interface such that as the bonus event graphic scrolls across the graphical user interface of one of the qualified gaming terminals to reach an edge of that graphical user interface a next one of the qualified gaming terminals in the sequence then initiates scrolling of that bonus event graphic across its graphical user interface whereby the bonus event graphic appears to scroll across successive graphical user interfaces of the sequence of qualified gaming terminals. At each of the qualified gaming terminals, a graphic element corresponding to a respective bonus event structure for that qualified gaming terminal is displayed.

In another aspect, the method may include, separately for each of the qualified gaming terminals, selecting, using a third probability, from amongst a plurality of bonus event structures a selected bonus event structure for that qualified gaming terminal and communicating the respective selected bonus event structures to the corresponding qualified gaming terminals.

In another aspect, the present application includes a community gaming system having at least a controller and two or more gaming terminals configured to perform one or more of the methods described herein.

In yet another aspect, the present application includes a processor-readable medium containing processor-executable instructions that, when executed, cause one or more processors to perform one or more of the methods described herein.

It should be appreciated that the description herein is by way of example only, and embodiments are not limited to providing any or all of the above-described functionality, although some embodiments may provide some or all of the functionality described herein.

The embodiments described herein can be implemented in any of numerous ways, and are not limited to any particular implementation techniques. Thus, while examples of specific implementation techniques are described below, it should be appreciated that the examples are provided merely for purposes of illustration, and that other implementations are possible.

One illustrative application for the techniques described herein is for use in a system for controlling a casino game machine. However, techniques described herein may be applied to any type of gaming device, including but not limited to a casino game machine (e.g., a slot machine), a PC, a laptop, a tablet, a smartphone, glasses with augmented reality technology, etc.

The term electronic gaming machine (EGM) may be used herein to refer to a single-player gaming terminal. The terms EGM and gaming terminal may be used interchangeably herein. The gaming terminal may be implemented as a stand-alone physical device within its own cabinet in some embodiments. In other embodiments, the gaming terminal may be implemented in a common cabinet with other gaming terminals as part of an integrated set of EGMs. Many of the embodiments below refer to a plurality of gaming terminals. In some embodiments, the plurality of gaming terminals may be part of an integrated unit, with each of the gaming terminal having its own graphical user interface. In such embodiments, the integrated unit may or may not also have one or more common screens on which messaging and graphics applicable to more than one of the users is displayed. In some other embodiments, the plurality of gaming terminals is distributed such that each gaming terminal is a stand-alone unit, but in communication with a central controller. In one embodiment, one of the EGMs in the plurality of EGMs serves as the central controller. In some embodiments, the central controller may be server or other processing device. The central controller may be located proximate the EGMs or in a remote location.

An exemplary electronic gaming machine (EGM) 10 (i.e. gaming terminal) is illustrated in perspective view in FIG. 1. Exemplary EGM 10, as depicted in FIG. 1, includes a display 12 that may be a thin film transistor (TFT) display, a liquid crystal display (LCD), a cathode ray tube (CRT) display, a light-emitting diode (LED) display, an organic LED (OLED) display, an autostereoscopic three dimensional (3D) display, or any other type of display. In some embodiments, a second display 14 may provide game data or other information in addition to display 12. Display 14 may provide static information, such as an advertisement for the game, the rules of the game, pay tables, pay lines, and/or other information, and/or may even display the main game or a bonus game along with display 12. Alternatively, the area for display 14 may be a display glass for conveying information about the game. Display 12 may also include a camera for use, for example, in presenting an autostereoscopic 3D display. In some embodiments display 12 and display 14 are one physical screen and display 12 indicates a portion of the screen on which a game-related animated graphical user interface is rendered, while display 14 indicates a portion of the screen upon which a relatively static graphical user interface is rendered.

Display 12 and/or display 14 may have a touch screen lamination that includes a transparent grid of conductors. A player touching the screen may change the capacitance between the conductors, and thereby the X-Y location of the touch on the screen may be determined. A processor within EGM 10 may associate this X-Y location with a function to be performed. There may be an upper and lower multi-touch screen in accordance with some embodiments.

In some embodiments, a coin slot 22 may accept coins or tokens in one or more denominations to generate credits within the EGM 10 for playing games. An input slot 24 for an optical reader and printer may receive machine readable printed tickets and may output printed tickets for use in cashless gaming.

A coin tray 32 may receive coins or tokens from a hopper (not shown) upon a win or upon the player cashing out. However, in some embodiments, the EGM 10 may not pay in cash, but may only issue a printed ticket for cashing in elsewhere. Alternatively, a stored value card may be loaded with credits based on a win, or may enable the assignment of credits to an account associated with a computer system, which may be a network-connected computer.

A card reader slot 34 may accept any of various types of cards, such as smart cards, magnetic strip cards, and/or other types of cards conveying machine readable information. The card reader may read the inserted card for player and/or credit information for cashless gaming. The card reader may read a magnetic code on a conventional player tracking card, where the code uniquely identifies the player to the host system. In some embodiments, the code may be cross-referenced by a host system to any data related to the player, and such data may affect the games offered to the player by the EGM 10. The card reader may also include an optical reader and printer for reading and printing coded barcodes and other information on a paper ticket. A card may also include credentials that enable the host system to access one or more accounts associated with a user. The account may be debited based on wagers by a user and credited based on a win.

A keypad 36 may accept player input, such as a personal identification number (PIN) and/or any other player information. A display 38 above keypad 36 may display a menu for instructions and/or other information, and/or may provide visual feedback of the keys pressed. The keypad 36 may be an input device such as a touchscreen, or dynamic digital button panel, in accordance with some embodiments.

In some embodiments, player control buttons 39 may include any buttons and/or other controllers usable for the play of the particular game or games offered by the EGM 10, including, for example, a bet button, a repeat bet button, a spin reels (or play) button, a maximum bet button, a cash-out button, a display pay lines button, a display payout tables button, select icon buttons, and/or any other suitable button(s). In some embodiments, buttons 39 may be replaced by a touch screen with virtual buttons. In some embodiments, touchless control gesture functionality may replace or coexist with buttons 39.

Figure 2:
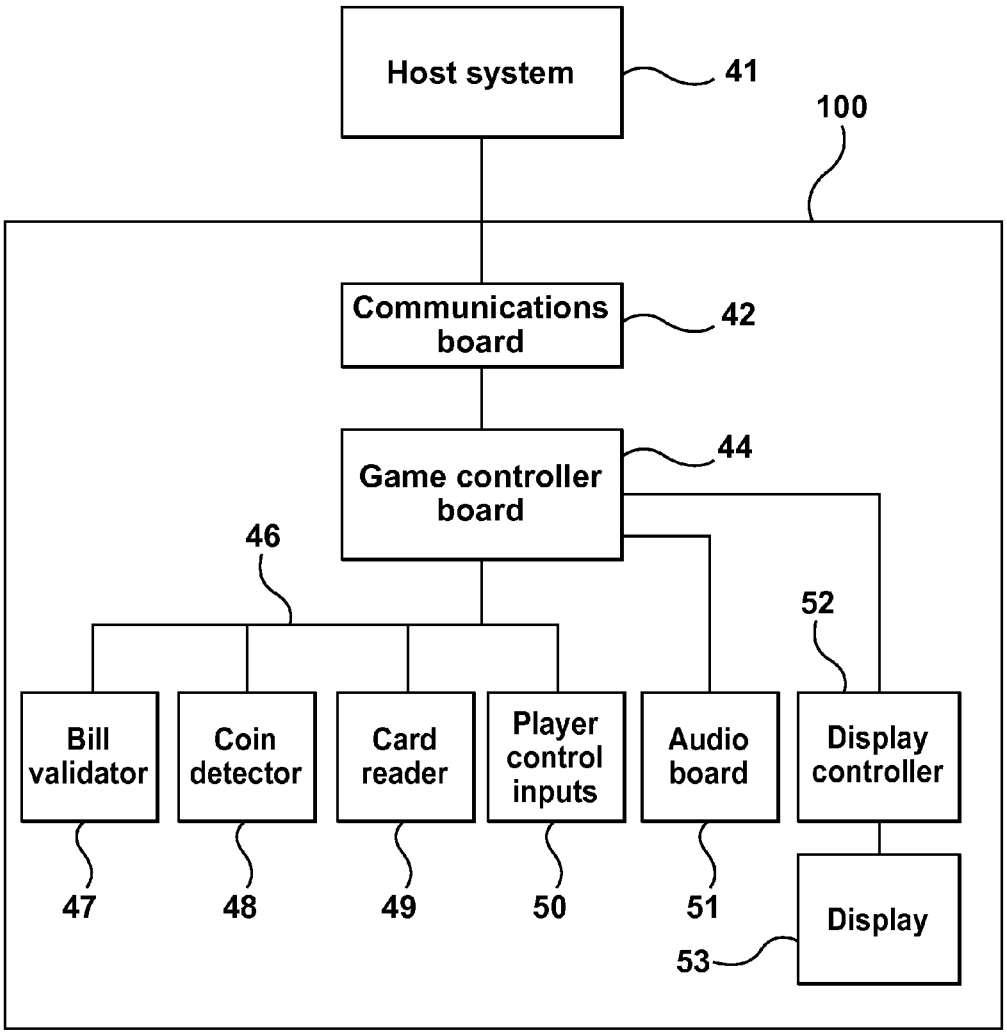
FIG. 2 is a block diagram of a casino game machine linked to a casino's host system in accordance with some embodiments.

FIG. 2 is a block diagram of one example of an EGM 100 linked to a host system 41. In the example shown, a communications board 42 may contain circuitry for coupling the EGM 100 to a local area network (LAN) and/or other type of network using any suitable protocol, such as the G2S protocols. Internet protocols are typically used for such communication under the G2S standard, incorporated herein by reference. Communications board 42 may transmit using a wireless transmitter, and/or may be directly connected to a wired network. Communications board 42 may set up a communication link with a master controller and may buffer data between the network and a game controller board 44. Communications board 42 may also communicate with a network server, such as in accordance with the G2S standard, for exchanging information to carry out embodiments described herein.

Game controller board 44 may contain memory and one or more processors for carrying out programs stored in the memory and for providing the information requested by the network. Game controller board 44 may execute programs stored in the memory and/or instructions received from host system 41 to carry out game routines.

Peripheral devices/boards may communicate with game controller board 44 via a bus 46 using, for example, an RS-232 interface. Such peripherals may include a bill validator 47, a coin detector 48, a smart card reader and/or other type of credit card reader 49, and/or player control inputs 50 (such as buttons 39 and/or a touch screen).

Game controller board 44 may also control one or more devices that produce the game output including audio and video output associated with a particular game that is presented to the user. For example, audio board 51 may convert coded signals into analog signals for driving speakers. Display controller 52 may convert coded signals into pixel signals for one or more displays 53 (e.g., display 12 and/or display 14). Display controller 52 and audio board 51 may be directly connected to parallel ports on game controller board 44. In some embodiments, the electronics on the various boards may be combined in any suitable way, such as onto a single board.

Figure 3:
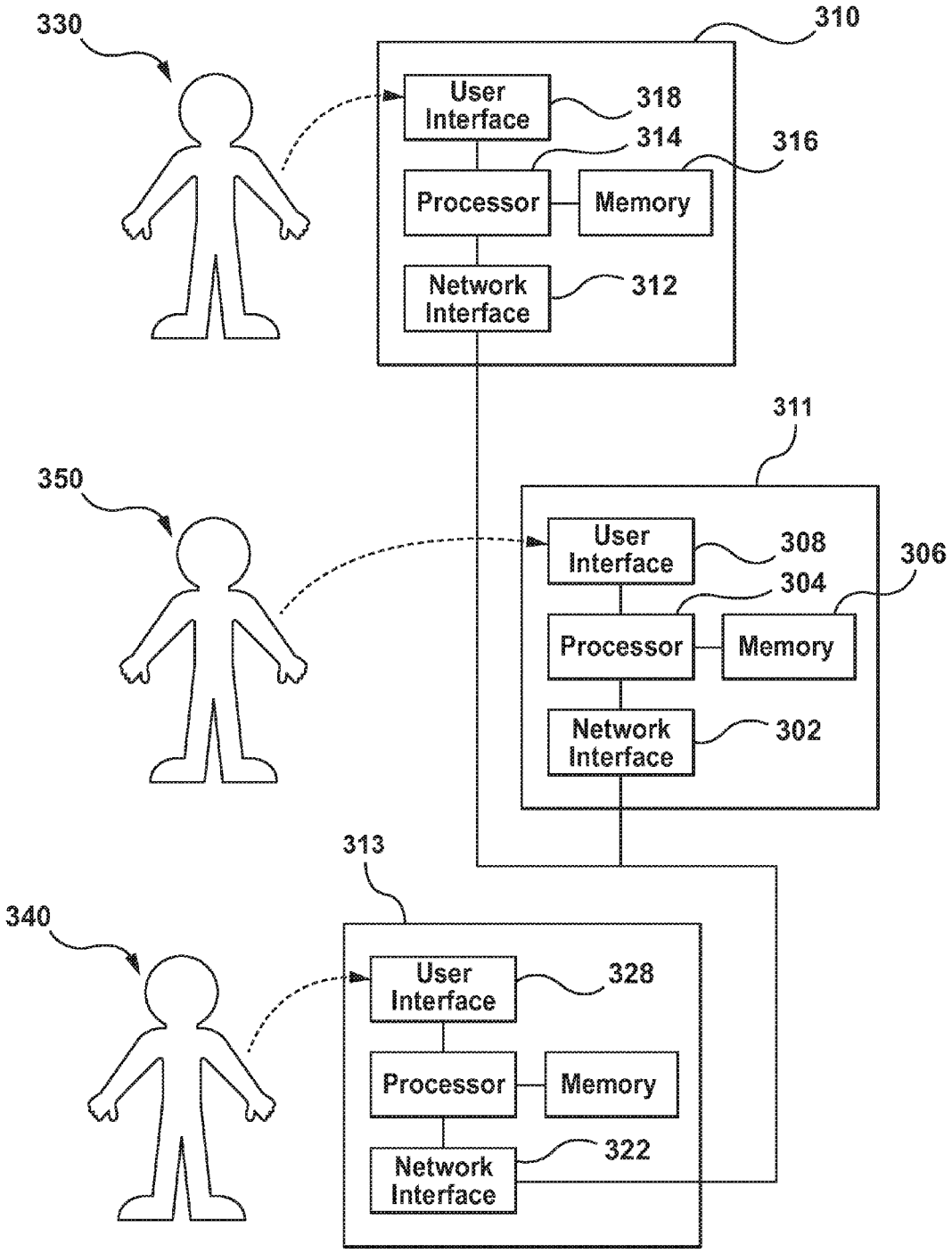
FIG. 3 is a block diagram illustrating an exemplary operating environment for a casino game machine in accordance with some embodiments.

FIG. 3 illustrates one example of a community gaming system that includes a plurality of EGMs 310, 311, 313. In this example embodiment, the role of central controller is delegated to exemplary master EGM 310. Master EGM 310 may be implemented in any suitable form, as embodiments are not limited in this respect. For example, master EGM 310 may be implemented as a single stand-alone machine, or may be implemented by multiple distributed machines that share processing tasks in any suitable manner. Master EGM 310 may be implemented as one or more computers; an example of a suitable computer is described below.

In some embodiments, master EGM 310 may include one or more tangible, non-transitory processor-readable storage devices storing processor-executable instructions, and one or more processors that execute the processor-executable instructions to perform the functions described herein. The storage devices may be implemented as computer-readable storage media (i.e., tangible, non-transitory computer-readable media) encoded with the processor-executable instructions; examples of suitable computer-readable storage media are discussed below. An example of a suitable storage medium is memory 316 depicted in FIG. 3, which is operatively connected to processor 314 for executing instructions stored in memory 316. In one example, processor 314 and memory 316 may be a processor and memory contained in game controller board 44, which may provide functionality for operating one or more games on casino game machine 100, in addition to providing control functionality described herein. In another example, processor 314 and/or memory 316 may be separate from game controller board 44 and may assert control signals upon game controller board 44 for affecting the operation of game controller board 44 in operating one or more games on EGM 100.

Exemplary control system 310 also includes a user interface component 318 configured to allow a user (player) 330 to interact with the EGM 310. User interface 318 may be implemented in any suitable form, as embodiments are not limited in this respect. In some embodiments, user interface 318 may configured to receive input from player 330 in any suitable form, such as by button, touchscreen, touchless control gesture, speech commands, etc., and may be configured to provide output to player 330 in any suitable form, such as audio output and/or visual output on a 2D or 3D display. In one exemplary embodiment, user interface 318 may include one or more components of EGM 100 (FIG. 2), such as player control inputs 50, audio board 51, display controller 52, and/or displays 53.

Within the community gaming system, EGMs 311 and 313 further include respective processors 304, memory 306, user interfaces 308, 328, and network interfaces 302, 322.

In some embodiments, one or more processors of an EGM 100 (FIG. 2) may execute stored instructions to present a graphical user interface for a reel-spinning game to a player. The processor may be configured to cause the graphical interface to virtually spin a set of virtual reels having various symbols located at regularly spaced intervals ("stops") on the reels. Portions of the virtual reels may be depicted on a display screen of the EGM 100 as if the physical reels were placed side-by-side behind a window that leaves only a limited number of symbols on each reel visible through the window at any time. The player may input a wager on one or more paylines, each corresponding to a pattern of symbol locations within the window on the reels. When the reels are spun, the symbols that appear in the window on the display when the reels stop spinning may be checked along each of the paylines on which a wager was input, to determine whether any winning symbol combinations occur on those paylines that result in a payout to the player.

Figure 4:
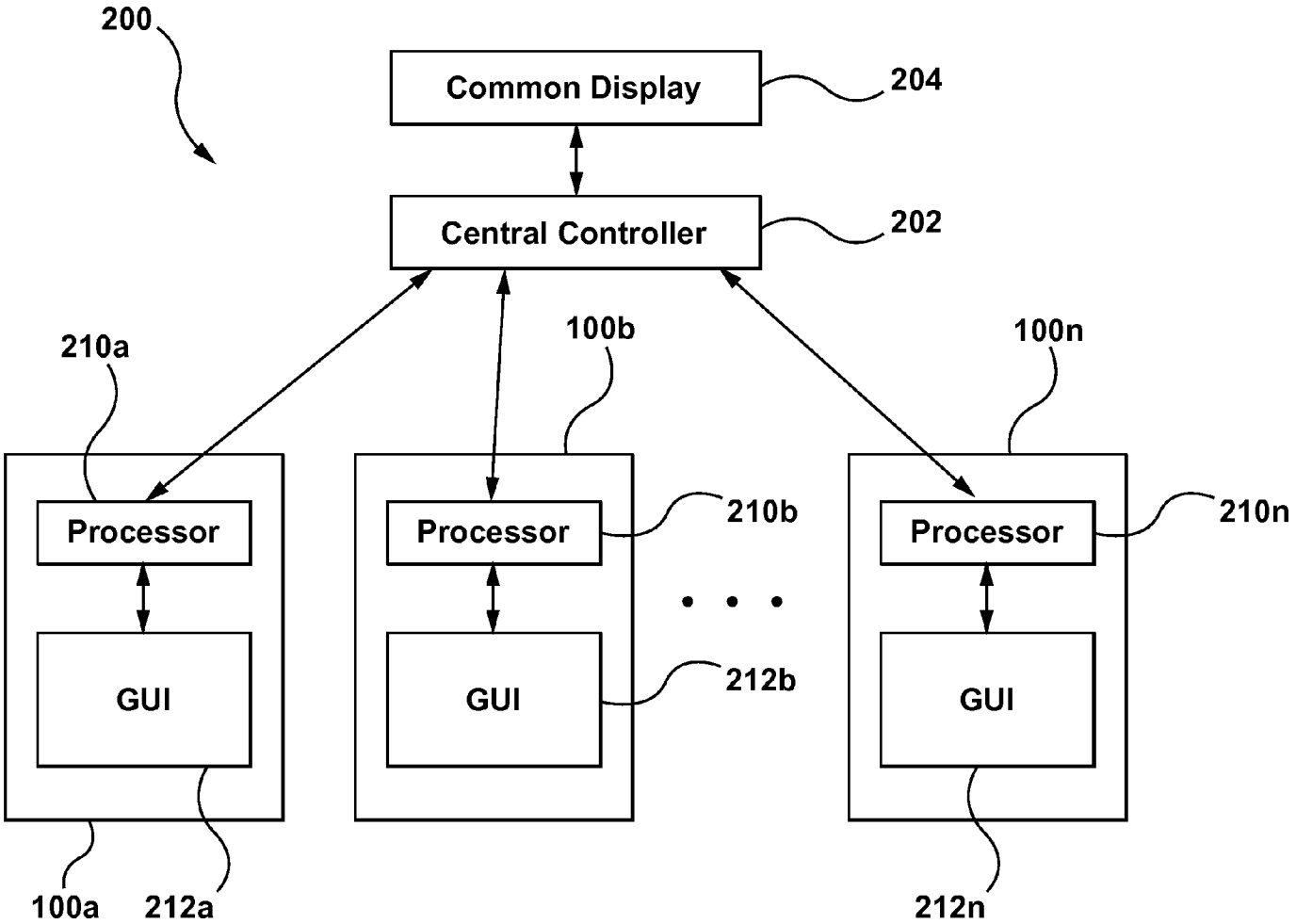
FIG. 4 is a block diagram of an example community gaming system.

Reference is now made to FIG. 4, which shows a block diagram of one example embodiment of a community gaming system 200. The community gaming system 200 in this example includes a plurality of EGMs 100 (indicated individually as 100*a*, 100*b*, . . . 100*n*). Each EGM 100 may include a processor 210 (indicated individually as 210*a*, 210*b*, . . . 210*n*), a graphical user interface 212 (indicated individually as 212*a*, 212*b*, . . . , 212*n*), and associated memory, I/O devices, network interfaces, and other computing elements (not shown). The community gaming system 200 further includes a central controller 202. The central controller 202 in this embodiment may be a processing device, such as a server or other computer. In some embodiments, the community gaming system 200 may also include a common display 204 visible to users of the EGMs 100. The central controller 202 is coupled to the EGMs 100, for example over a wired or wireless network, so as to exchange communications.

Conventional EGMs provide stand-alone game play for the user. Within a community gaming system, the stand-along game play may be interrupted to present a common bonus event to all players active in the community gaming system. During such a common bonus event, the community gaming system may be configured to display graphics regarding the bonus event on a common display screen viewable by players at all EGMs in the community gaming system, or may be configured to cause all the EGMs to show the graphics regarding the bonus event on their respective display screens simultaneously. This feature of community gaming systems, whereby all EGMs in active use are occasionally interrupted to participate in a common bonus event, creates a community experience for the players.

In accordance with one aspect of the present application, a community gaming system is configured to operate a common bonus event on a differentiated basis, such that each of the EGMs within the community gaming system participating in the bonus event receives or implements a respective randomly-selected bonus event structure. The random selection may result in all EGMs having the same bonus event structure or one or more of the EGMs having a different bonus event structure.

In accordance with another aspect of the present application, the graphical user interfaces of the EGMs are controlled so as to visually communicate the differentiated nature of the bonus event. In one aspect, a central controller may identify a sequence of participating or validated EGMs for the bonus event and may cause each EGM to successively cause a bonus event graphic to scroll across its respective display. In one example, the start time for scrolling the bonus event graphic on one display is initiated when the bonus event graphic is scrolled to an edge of the display screen of the previous EGM in the sequence, such that the bonus event graphic appears to be scrolling across each of the display screens of the EGMs in sequence. In one embodiment, as the bonus event graphic is scrolled off of an EGM's display screen, that EGM updates its graphical user interface to indicate its respective selected bonus event structure.

Figure 5A:
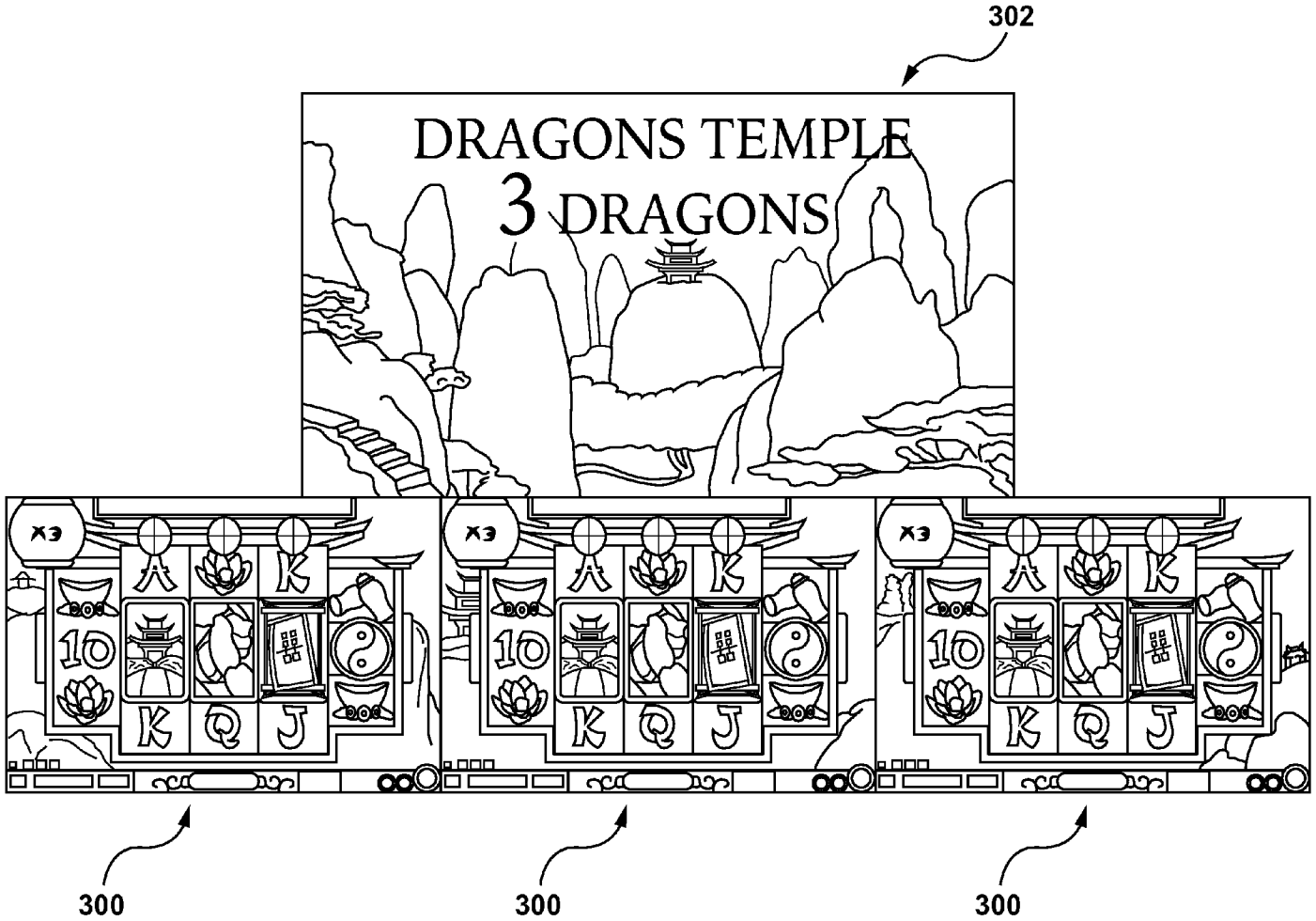
FIGS. 5*a*-5*d* illustrate graphic user interfaces for implementing a differentiated bonus event on a community gaming system.

FIG. 5A illustrates a collection of example graphical user interfaces rendered on the screens of a community gaming system. In this example, the bottom row shows the respective display screens 300 of three EGMs. A common display screen 302 is illustrated as having a graphical user interface containing the text "DRAGONS TEMPLE" indicative of the name of the community gaming system in this example. The EGMs each control their respective display screens 300 to render their respective graphical user interfaces, detect user input, perform probability determinations in accordance with preset return percentages, and update their respective graphical user interfaces during normal game play. In this example, the display screens 300 of the EGMs show a virtual reel-based wagering game interface. One example implementation of a virtual reel-based gaming interface is described in U.S. patent application Ser. No. 14/287,629, filed May 27, 2014, the contents of which are hereby incorporated by reference. The present application is not necessarily limited to virtual reel-based gaming interfaces.

As noted above, individual EGMs may qualify for participation in a bonus event. During each activation of the EGM, i.e. each "spin" or "wager", the individual EGM determines whether it has qualified for the bonus event. This determination may be based upon a preset qualification probability and a randomly generated number. The preset qualification probability may be scaled in accordance with a wager amount or other factors required or permissible under the prevailing return percentage constraints applicable to the EGM. If the determination is that the EGM has qualified, then the graphical user interface may be updated to notify the user that the EGM has qualified.

If the EGM qualifies for the bonus event, it saves data in memory noting that its status as a qualified gaming terminal. This may include updating a data structure in memory tracking bonus event qualifications. The EGM may alternatively or additionally transmit a communication to the central controller containing data indicating that the EGM is a qualified gaming terminal.

In some implementations, the EGM may qualify more than once for the bonus event. Multiple qualifications for a bonus event may results in scaled probabilities relating to the bonus event and/or prize multipliers. In some embodiments, each qualification for the bonus event increments a prize multiplier by one. The incremented multiplier is stored in memory by the EGM. The EGM may also transmit a signal to the central controller to provide the central controller with up-to-date multiplier status for the qualified gaming terminal.

Each activation of the EGM, i.e. each "spin" or "wager", also results in a signal from the EGM to the central controller to notify the central controller that the EGM has been activated. Each activation may further trigger a bonus event possibility at the central controller. The central controller determines whether a bonus event has been triggered based upon a bonus event probability and a randomly generated number.

When the central controller determines that a bonus event has been triggered, it then notifies the EGMs to enter a bonus event state. In this example, only active EGMs that have "qualified", i.e. that have determined that they are qualified gaming terminals, may participate in the bonus event. Unqualified gaming terminals (either those that are not in active use, or those in active use that have not qualified for a bonus event) may either enter a suspended game state during which those terminals cannot be activated or they may be permitted to continue regular game play while the qualified gaming terminals participate in the bonus event.

If a qualified gaming terminal is engaged in completing an active regular game play operation, then it completes that operation while the central controller and other qualified gaming terminals await that completion. In order to effect this, each qualified gaming terminal sends the central controller a ready signal indicating that the respective gaming terminal has completed any game play operation that was in progress when the bonus event notification was received from the central controller. Once the central controller receives ready signals from each of the qualified gaming terminals in the community gaming system, then it may initiate the bonus event.

In one embodiment, the EGMs report their qualification status for bonus events to the central controller as the qualification is achieved. In such a case, the central controller has a stored record indicating which EGMs are qualified when a bonus event is triggered. Accordingly, it may only notify those EGMs of the bonus event in some embodiments. In another example, the EGMs only report their qualification status once the central controller transmits a bonus event notification.

Figure 5B:
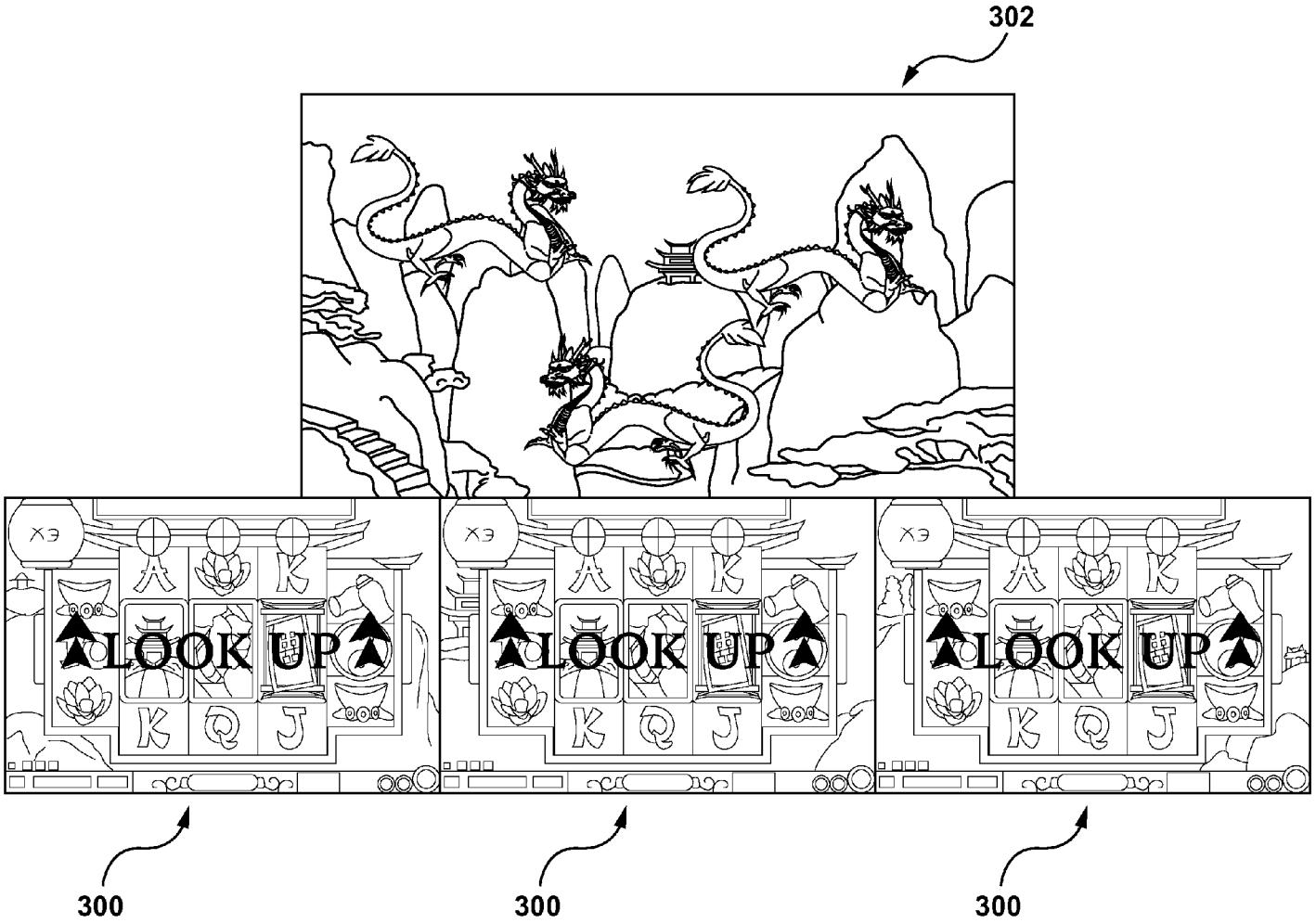

FIG. 5*b* illustrates one example set of graphical user interfaces for the initiation of a bonus event sequence in a community gaming system. In this example, each of the screens 300 of the EGMs features a graphical partly-transparent overlay prompting users to observe the common display screen 302. The common display screen 302 shows an animated sequence. In this specific example, the animated sequence of three flying dragons graphically illustrates three possible bonus events, each having a different game play feature or prize feature.

The central controller identifies a sequence of the qualified EGMs. In some implementations, the EGMs have a predefined sequence that corresponds to their physical arrangement. For example, when the EGMs physically adjacent to each other in a row, the leftmost EGM may be designated as the first EGM in the predefined sequence, and the rightmost EGM as the last EGM in the predefined sequence. The predefined sequence may serve as the basis for the central controller to determine the sequence of qualified EGMs, since not all EGMs in the predefined sequence may be qualified for the bonus event.

The central controller also selects a bonus event structure for each EGM. In this example, the bonus event may have a plurality of optional features. In some instances, these features may be alternatives to one another. In some instances, the features may be cumulative. The combination of features is termed the "bonus event structure" herein. In one example, a feature is a "wild" card position on a reel. Another example feature may be a full reel of "wild" cards.

Yet another example feature is "surrounding wilds". Other game play features may be used in other embodiments.

Using a bonus feature probability, the central controller randomly selects, for each qualified EGM individually, the bonus event structure for that EGM—i.e. the features that are to be applied by that EGM in implementing the bonus event. Each qualified EGM may thus end up with a different feature or set of features to be implemented during the bonus event. The differentiated bonus event structures across EGMs is over and above any different in outcome attributable to different wagers input to the respective EGMs.

The EGMs each receive their respective selected bonus event structure information from the central controller and implement the bonus event. Implementing the bonus event may include graphically displaying images in accordance with the selected bonus event structure information received from the central controller, awaiting user input to trigger the bonus event operation, and determining using a bonus event probability the resulting combination of symbols for display as a bonus event outcome. The EGM then determines from the displayed combination of symbols and a payline pattern and wager the result and a corresponding display is output to indicate to the user whether the wager was lost or won and, if won, the resultant payout.

Before conducting the bonus event, the EGMs graphically communicate the initiation of the differentiated bonus event under control of the central controller. In particular, the central controller initiates scrolling of a bonus event graphic across the screens of the sequence of EGMs in succession.

Figure 5C:
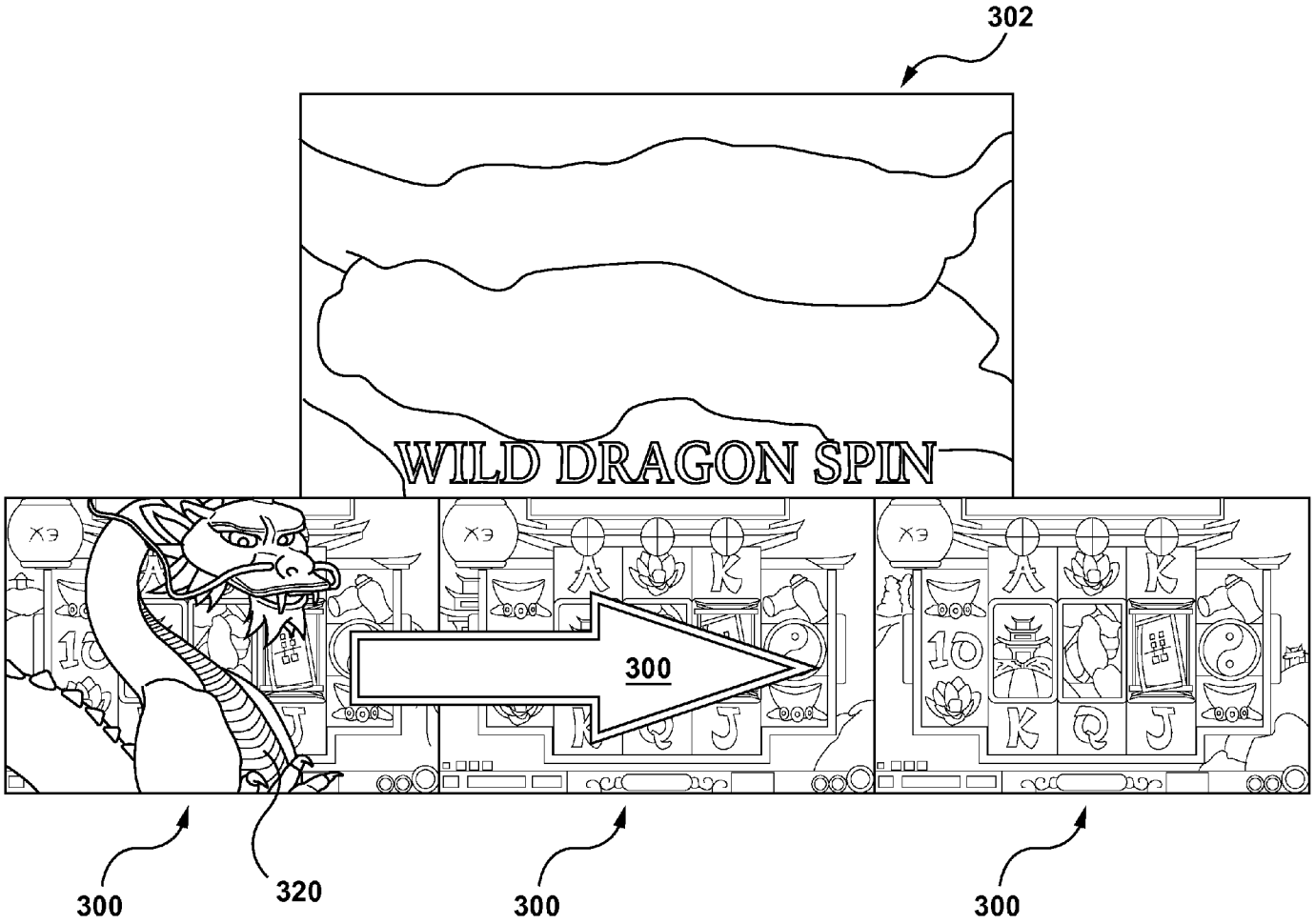

FIG. 5*c* shows one example set of graphical user interfaces for scrolling a bonus event graphic 320 in a community gaming system. In this example, the bonus event graphic 320 is the blue dragon graphic shown in the leftmost EGMs display screen 300. As indicated by arrow 330, the bonus event graphic 320 is scrolled across the screens 300 in succession so as to make it appear that the bonus event graphics 320 is passing from one screen 300 to the next in sequence, thereby emphasizing the communal participation of the qualified EGMs in the bonus event.

In one embodiment, the central controller may initiate scrolling of the graphic by sending the first EGM in the sequence a scrolling trigger signal. In response, the first EGM begins scrolling the bonus event graphic 320 across its display screen 300. Note that the scrolling in this example is left to right, but in other examples it could be right to left, top to bottom, bottom to top, diagonal, or in any other direction.

In one example implementation, the central controller sends successive scrolling trigger signals to qualified EGMs in the sequence based upon a predetermined time delay, where the predetermined time delay is precalculated as the time for each EGM to scroll the bonus event graphic 320 such that a leading edge of the bonus event graphic 320 traverses the screen, i.e. is scrolled into an edge of the display screen 300. Based on that time delay, each EGM in the sequence begins its scrolling in turn so as to give the impression of the bonus event graphic 320 crossing the screens seamlessly in succession.

In another example implementation, the EGM determines when the bonus event graphic 320 has been scrolled such that its leading edge meets an edge of the display screen 300. In response to that determination, the EGM notifies the central controller that the bonus event graphic 320 has reached an edge and the central controller then sends a scrolling trigger signal to the next EGM in the sequence.

It will be understood that the bonus event graphic 320 may, in some embodiments, be wider than the display screen 300, such that scrolling of the graphic 320 continues after the leading edge of the graphic 320 has been "scrolled off" the display screen 300.

After, or while, the trailing edge of the bonus display graphic 320 is scrolled off the display screen 300, the EGM updates its graphical user interface to display graphical elements corresponding to its respective selected bonus event structure. For example, if the selected bonus event structure for an EGM includes a full reel of wild symbols, the graphical user interface is updated to show that feature.

Figure 5D:
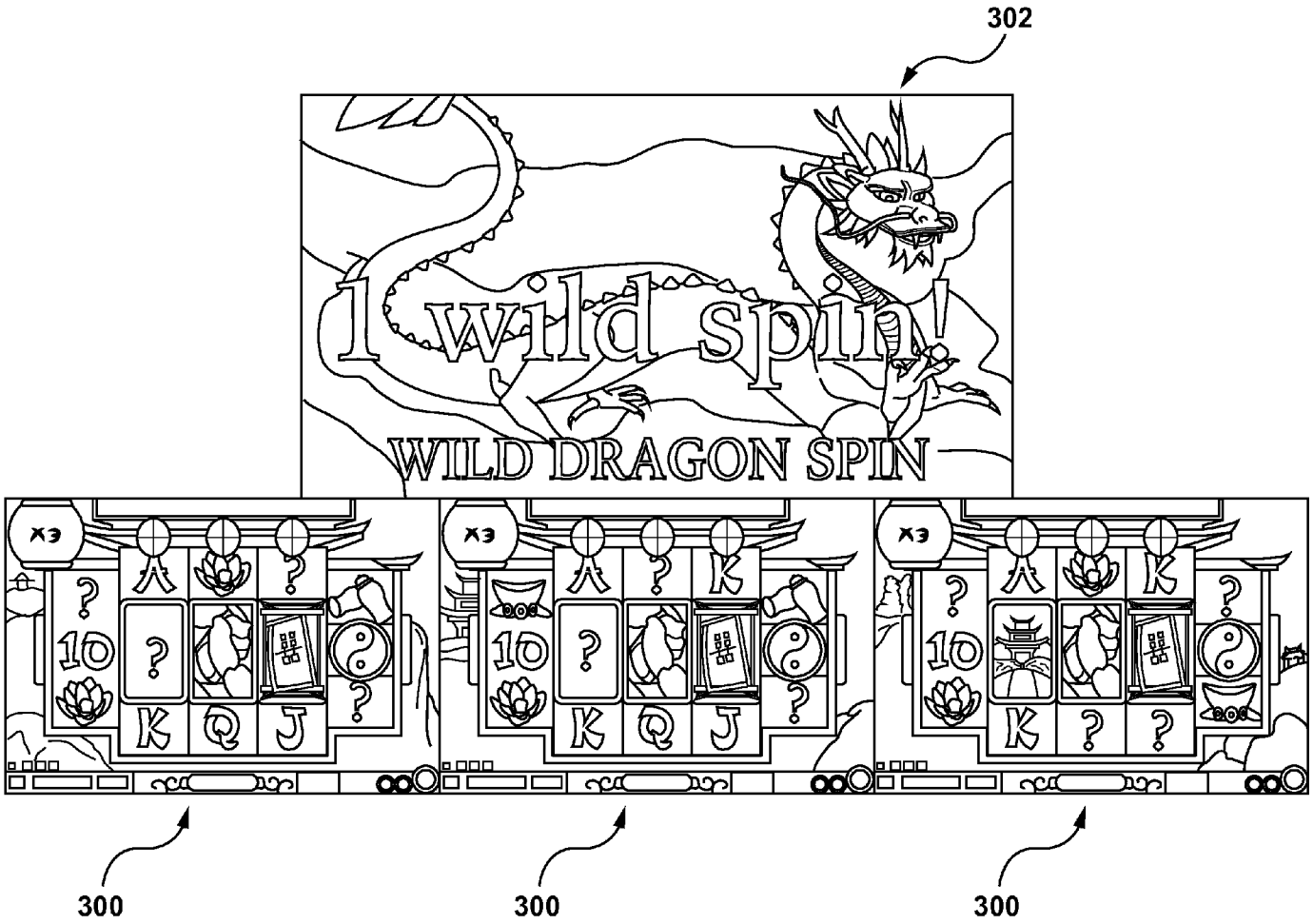

FIG. 5*d* shows one example set of graphical user interfaces showing differentiated bonus event structures in a community gaming system. In this example illustration, the leftmost EGM display screen 300 shows wild symbols (in this example, the wild symbols are question marks but they could be any symbol intended to convey a wild) in the two leftmost reels and two rightmost reels but not the center reel. The middle EGM display 300 shows only three wild symbols. The rightmost EGM display 300 shows wild symbols on the leftmost reels and the three rightmost reels, but not the second reel. The result is that the users of the respective EGMs have different bonus structures for the bonus event.

Although the foregoing examples show three qualified EGMs in the bonus event, it will be appreciated that the present differentiated bonus event structure may also be applied in the case of two qualified EGMs or four or more qualified EGMs, within a community gaming system.

Figure 6:
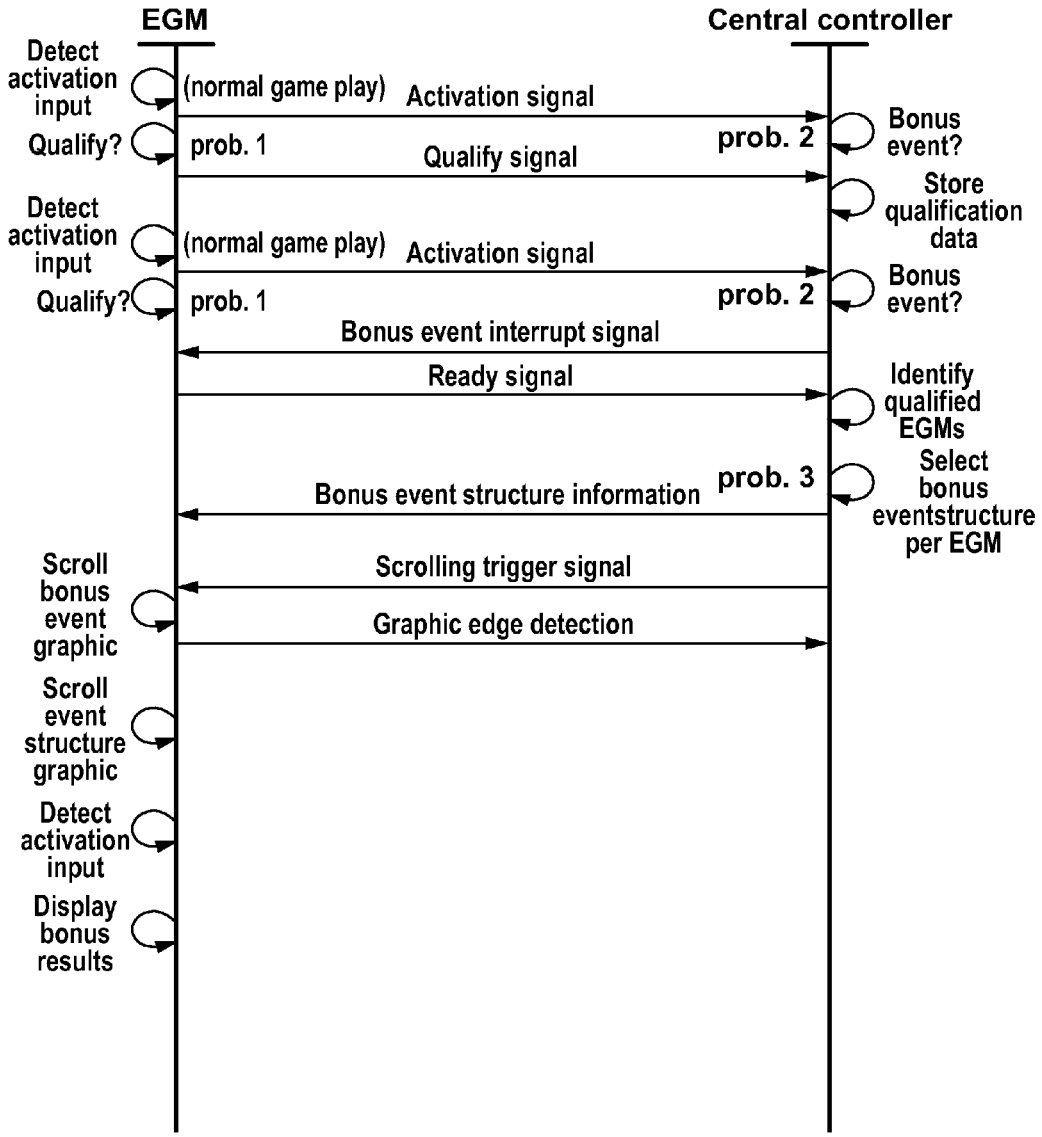
FIG. 6 is an example signal diagram for a community gaming system.

Reference is now made to FIG. 6, which shows one example of a simplified signal diagram 400 for a portion of a community gaming system. In this example signal diagram 400, only one EGM and the central controller are illustrated. It will be understood that similar signaling communications occur between other EGMs and the central controller.

In the example signal diagram 400, the EGM detects activation input, e.g. user input of a wager amount or activation of a play button to initiate normal gameplay. The EGM in this example notifies the central controller of the gameplay activation. The EGM then tests whether the activation results in a qualification for bonus events using a first probability. In this example, the result is positive, and the EGM sends a qualify signal to the central controller. The central controller stores information in memory noting the qualification of the EGM for bonus events. The central controller also determines, using a second probability, whether the activation results in a bonus event. In the first example, it does not.

The signal diagram 400 shows a second detected activation at the EGM. The same communication and processing sequence is carried out, but in this example, the central controller determines that a bonus event is to occur based on the second probability and a randomly-generated number. Accordingly, it sends a bonus event interrupt signal to the EGM. When the EGM is finished any ongoing gameplay routine, it responds to the central controller with a ready signal. The central controller then identifies the qualified EGMs based on stored data and for each qualified EGM it selects a respective bonus event structure (i.e. bonus feature or combination of features) using a third probability.

The respective selected bonus event structure is sent to the corresponding EGM. The EGM then awaits a scrolling trigger signal to initiate scrolling of the bonus event graphic across its display screen. In this example embodiment, the EGM notifies the central controller when the leading edge of the graphic reaches an edge of the screen so that the central controller can trigger scrolling at the next EGM in the sequence of EGMs. As noted above, in another embodiment, the central controller may send trigger signals to the EGMs in sequence based upon a predetermined timing delay.

The EGM then implements the bonus event structure in accordance with the bonus event structure information received and graphically displays the bonus event structure. The EGM then awaits detection of an activation input at which point it runs the bonus event and determines the outcome. The bonus even results are then displayed on the EGM display screen and the resultant payout, if any, is triggered.

Figure 7:
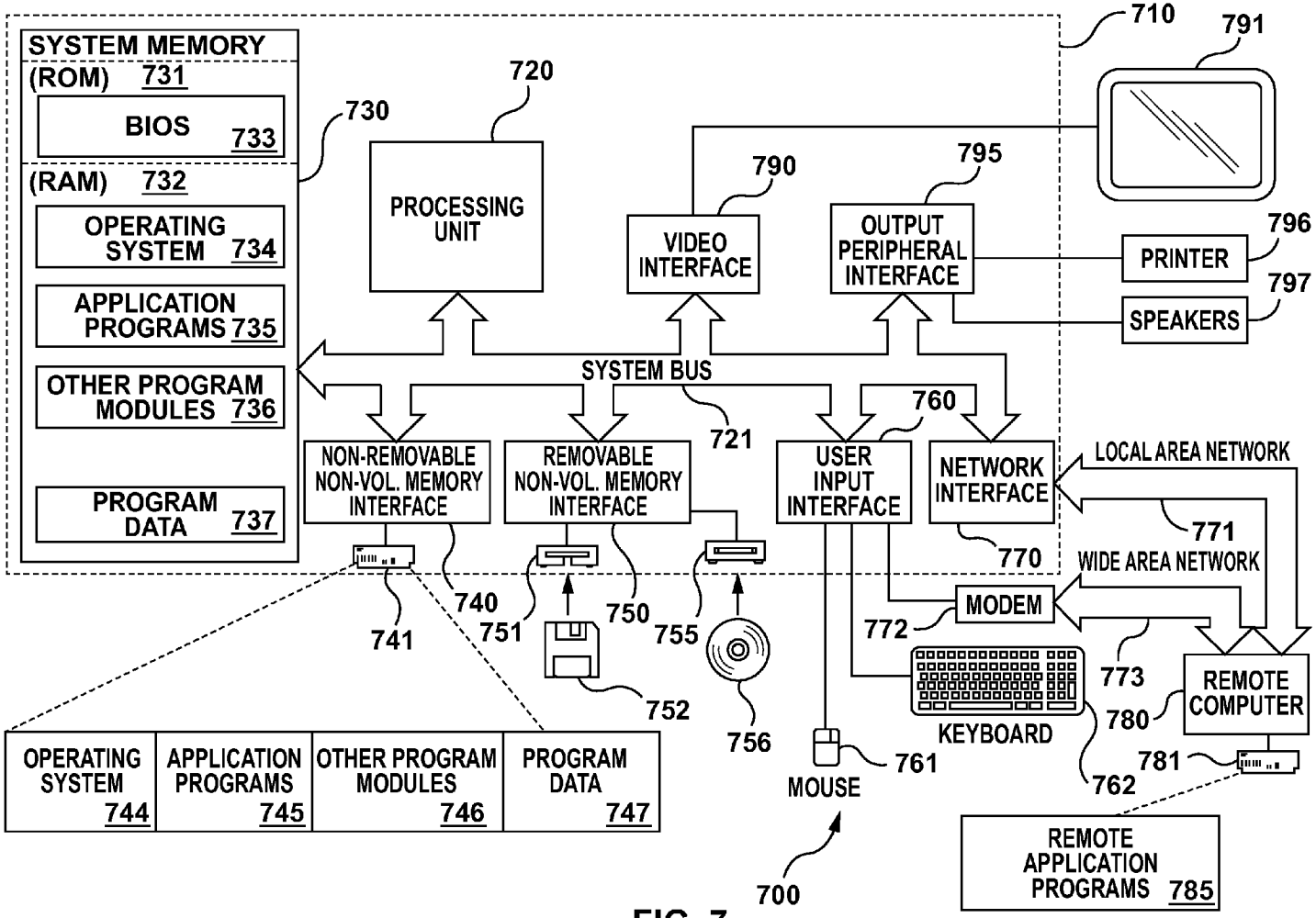
FIG. 7 is a schematic diagram of an exemplary computing environment in which some embodiments may be implemented.

FIG. 7 illustrates an example of a suitable computing system environment 700 in which some embodiments may be implemented. This computing system may be representative of a computing system that allows a suitable control system to implement the described techniques. However, it should be appreciated that the computing system environment 700 is only one example of a suitable computing environment and is not intended to suggest any limitation as to the scope of use or functionality of the described embodiments. Neither should the computing environment 700 be interpreted as having any dependency or requirement relating to any one or combination of components illustrated in the exemplary operating environment 700.

The embodiments are operational with numerous other general purpose or special purpose computing system environments or configurations. Examples of well-known computing systems, environments, and/or configurations that may be suitable for use with the described techniques include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The computing environment may execute computer-executable instructions, such as program modules. Generally, program modules include routines, programs, objects, components, data structures, etc., that perform particular tasks or implement particular abstract data types. The embodiments may also be practiced in distributed computing environments where tasks are performed by remote processing devices that are linked through a communications network. In a distributed computing environment, program modules may be located in both local and remote computer storage media including memory storage devices.

With reference to FIG. 7, an exemplary system for implementing the described techniques includes a general purpose computing device in the form of a computer 710. Components of computer 710 may include, but are not limited to, a processing unit 720, a system memory 730, and a system bus 721 that couples various system components including the system memory to the processing unit 720. The system bus 721 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 710 typically includes a variety of computer readable media. Computer readable media can be any available media that can be accessed by computer 710 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 710. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 730 includes computer storage media in the form of volatile and/or nonvolatile memory such as read only memory (ROM) 731 and random access memory (RAM) 732. A basic input/output system 733 (BIOS), containing the basic routines that help to transfer information between elements within computer 710, such as during start-up, is typically stored in ROM 731. RAM 732 typically contains data and/or program modules that are immediately accessible to and/or presently being operated on by processing unit 720. By way of example, and not limitation, FIG. 7 illustrates operating system 734, application programs 735, other program modules 736, and program data 737.

The computer 710 may also include other removable/non-removable, volatile/nonvolatile computer storage media. By way of example only, FIG. 7 illustrates a hard disk drive 741 that reads from or writes to non-removable, nonvolatile magnetic media, a magnetic disk drive 751 that reads from or writes to a removable, nonvolatile magnetic disk 752, and an optical disk drive 755 that reads from or writes to a removable, nonvolatile optical disk 756 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 741 is typically connected to the system bus 721 through a non-removable memory interface such as interface 740, and magnetic disk drive 751 and optical disk drive 755 are typically connected to the system bus 721 by a removable memory interface, such as interface 750.

The drives and their associated computer storage media discussed above and illustrated in FIG. 7 provide storage of computer readable instructions, data structures, program modules and other data for the computer 710. In FIG. 7, for example, hard disk drive 741 is illustrated as storing operating system 744, application programs 745, other program modules 746, and program data 747. Note that these components can either be the same as or different from operating system 734, application programs 735, other program modules 736, and program data 737. Operating system 744, application programs 745, other program modules 746, and program data 747 are given different numbers here to illustrate that, at a minimum, they are different copies. A user may enter commands and information into the computer 710 through input devices such as a keyboard 762 and pointing device 761, commonly referred to as a mouse, trackball or touch pad. Other input devices (not shown) may include a microphone, joystick, game pad, satellite dish, scanner, touchscreen, or the like. These and other input devices are often connected to the processing unit 720 through a user input interface 760 that is coupled to the system bus, but may be connected by other interface and bus structures, such as a parallel port, game port or a universal serial bus (USB). A monitor 791 or other type of display device is also connected to the system bus 721 via an interface, such as a video interface 790. In addition to the monitor, computers may also include other peripheral output devices such as speakers 797 and printer 796, which may be connected through an output peripheral interface 795.

The computer 710 may operate in a networked environment using logical connections to one or more remote computers, such as a remote computer 780. The remote computer 780 may be a personal computer, a server, a router, a network PC, a peer device or other common network node, and typically includes many or all of the elements described above relative to the computer 710, although only a memory storage device 781 has been illustrated in FIG. 7. The logical connections depicted in FIG. 7 include a local area network (LAN) 771 and a wide area network (WAN) 773, but may also include other networks. Such networking environments are commonplace in offices, enterprise-wide computer networks, intranets and the Internet.

When used in a LAN networking environment, the computer 710 is connected to the LAN 771 through a network interface or adapter 770. When used in a WAN networking environment, the computer 710 typically includes a modem 772 or other means for establishing communications over the WAN 773, such as the Internet. The modem 772, which may be internal or external, may be connected to the system bus 721 via the user input interface 760, or other appropriate mechanism. In a networked environment, program modules depicted relative to the computer 710, or portions thereof, may be stored in the remote memory storage device. By way of example, and not limitation, FIG. 7 illustrates remote application programs 785 as residing on memory device 781. It will be appreciated that the network connections shown are exemplary and other means of establishing a communications link between the computers may be used.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation comprises at least one processor-readable storage medium (i.e., at least one tangible, non-transitory processor-readable medium, e.g., a computer memory (e.g., hard drive, flash memory, processor working memory, etc.), a floppy disk, an optical disc, a magnetic tape, or other tangible, non-transitory processor-readable medium) encoded with a computer program (i.e., a plurality of instructions), which, when executed on one or more processors, performs at least the above-discussed functions. The processor-readable storage medium can be transportable such that the program stored thereon can be loaded onto any computer resource to implement functionality discussed herein. In addition, it should be appreciated that the reference to a computer program which, when executed, performs above-discussed functions, is not limited to an application program running on a host computer. Rather, the term "computer program" is used herein in a generic sense to reference any type of computer code (e.g., software or microcode) that can be employed to program one or more processors to implement above-discussed functionality.

The phraseology and terminology used herein is for the purpose of description and should not be regarded as limiting. The use of "including," "comprising," "having," "containing," "involving," and variations thereof, is meant to encompass the items listed thereafter and additional items. Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described several embodiments of the invention, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

The invention claimed is:

1. A method of controlling a plurality of graphical user interfaces, wherein the plurality of graphical user interfaces form a community gaming system, each graphical user interface operating as a gaming terminal, each graphical user interface comprising a plurality of symbols arranged in a pattern indicative of a payout for a game operation of the gaming terminal, the system including at least one central controller, the method comprising:

each gaming terminal determining, based upon regular user gaming input received at that gaming terminal and a first probability, whether that gaming terminal qualifies for a bonus event as a qualified gaming terminal;

determining, at the central controller, based upon a second probability, that the bonus event is triggered;

identifying, by the central controller, a sequence of qualified gaming terminals for the bonus event;

transmitting a trigger signal from the central controller to each of the qualified gaming terminals in the sequence in turn, in response to which each qualified gaming terminal initiates scrolling of a bonus event graphic across its respective graphical user interface in front of the plurality of symbols of the respective graphical user interface such that, as the bonus event graphic scrolls across the graphical user interface of one of the qualified gaming terminals to reach an edge of that graphical user interface, a next one of the qualified gaming terminals in the sequence then simultaneously initiates scrolling of that bonus event graphic across its graphical user interface whereby the bonus event graphic appears to scroll across successive graphical user interfaces of the sequence of qualified gaming terminals in front of the plurality of symbols of each graphical user interface; and at each of the qualified gaming terminals, displaying a graphic element corresponding to a respective bonus event structure for that qualified gaming terminal.

2. The method claimed in claim 1, wherein the central controller stores a default sequence of gaming terminals and wherein identifying, by the central controller, a sequence of qualified gaming terminals comprises identifying which of the gaming terminals in the default sequence of gaming terminals are qualified gaming terminals.

3. The method claimed in claim 1, wherein the bonus event graphic is larger than any one of the graphical user interfaces such that as it scrolls across the next one of the qualified gaming terminals it has not yet finished scrolling across the graphical user interface of said one of the qualified gaming terminals.

4. The method claimed in claim 1, further comprising, separately for each of the qualified gaming terminals, at the central controller using a third probability, selecting from amongst a plurality of bonus event structures a selected bonus event structure for that qualified gaming terminal and communicating the respective selected bonus event structures to the corresponding qualified gaming terminals.

5. The method claimed in claim 1, wherein the respective selected bonus event structures are distinct.

6. The method claimed in claim 1, wherein, after determining that the bonus event is triggered, the central controller sends a signal to each qualified gaming terminal regarding initiation of the bonus event and awaits receipt of a ready signal from each qualified gaming terminal before transmitting the trigger signal.

7. The method claimed in claim 6, wherein each qualified gaming terminal completes any regular game operation in progress prior to sending its ready signal.

8. The method claimed in claim 1, wherein the central controller sends the trigger signals in sequence based upon a predetermined time delay between respective trigger signals.

9. The method claimed in claim 1, wherein the central controller sends each trigger signal after a first trigger signal in the sequence based upon receipt of a notification from a respective qualified gaming terminal indicating that the bonus event graphic has been scrolled to an edge of its graphical user interface.

10. A community gaming system comprising:

a central controller; and a plurality of gaming terminals coupled to the central controller, each gaming terminal having a respective processor and a respective graphical user interface, each graphical user interface comprising a plurality of symbols arranged along at least one payline, each respective processor configured to determine, based upon regular user gaming input received at that gaming terminal and a first probability, whether that gaming terminal qualifies for a bonus event as a qualified gaming terminal, the central controller configured to determine, based upon a second probability, that the bonus event is triggered and to identify a sequence of qualified gaming terminals for the bonus event, wherein the central controller is further configured to transmit a trigger signal to each of the qualified gaming terminals in the sequence in turn, in response to which each qualified gaming terminal initiates scrolling of a bonus event graphic across its respective graphical user interface in front of the plurality of symbols arranged along the at least one payline of the respective graphical user interface such that, as the bonus event graphic scrolls across the graphical user interface of one of the qualified gaming terminals to reach an edge of that graphical user interface a next one of the qualified gaming terminals in the sequence then simultaneously initiates scrolling of that bonus event graphic across its graphical user interface whereby the bonus event graphic appears to scroll across successive graphical user interfaces of the sequence of qualified gaming terminals in front of the plurality of symbols arranged along the at least one payline of each graphical user interface, and wherein each of the processor is configured to cause its respective graphical user interface to display a graphic element corresponding to the respective selected bonus event structure selected for that qualified gaming terminal.

11. The community gaming system claimed in claim 10, wherein the central controller stores a default sequence of gaming terminals and wherein identifying, by the central controller, a sequence of qualified gaming terminals comprises identifying which of the gaming terminals in the default sequence of gaming terminals are qualified gaming terminals.

12. The community gaming system claimed in claim 10, wherein the bonus event graphic is larger than any one of the graphical user interfaces such that as it scrolls across the next one of the qualified gaming terminals it has not yet finished scrolling across the graphical user interface of said one of the qualified gaming terminals.

13. The community gaming system claimed in claim 10, wherein the central controller is to, separately for each of the qualified gaming terminals, using a third probability, select from amongst a plurality of bonus event structures a selected bonus event structure for that qualified gaming terminal and communicate the respective selected bonus event structures to the corresponding qualified gaming terminals.

14. The community gaming system claimed in claim 10, wherein the respective selected bonus event structures are distinct.

15. The community gaming system claimed in claim 10, wherein, after determining that the bonus event is triggered, the central controller is to send a signal to each qualified gaming terminal regarding initiation of the bonus event and await receipt of a ready signal from each qualified gaming terminal before transmitting the trigger signal.

16. The community gaming system claimed in claim 15, wherein each qualified gaming terminal is to complete any regular game operation in progress prior to sending its ready signal.

17. The community gaming system claimed in claim 10, wherein the central controller is to send the trigger signals in sequence based upon a predetermined time delay between respective trigger signals.

18. The community gaming system claimed in claim 10, wherein the central controller is to send each trigger signal after a first trigger signal in the sequence based upon receipt of a notification from a respective qualified gaming terminal indicating that the bonus event graphic has been scrolled to an edge of its graphical user interface.

19. The community gaming system claimed in claim 10, wherein each gaming terminal comprises a separate physical housing.

20. A non-transitory computer-readable medium containing program instructions that, when executed by one or more processors, cause the one or more processors to carry out the method claimed in claim 1.

21. The method claimed in claim 1, wherein, for each graphical user interface, the plurality of symbols arranged in a pattern indicative of a payout comprises the plurality of symbols arranged along at least one payline.

22. The community gaming system claimed in claim 10, wherein, for each graphical user interface, the plurality of symbols arranged in a pattern indicative of a payout comprises the plurality of symbols arranged along at least one payline.

* * * * *